United States Patent [19]

Suzuki et al.

[11] Patent Number: 4,905,560

[45] Date of Patent: Mar. 6, 1990

[54] MUSICAL TONE CONTROL APPARATUS MOUNTED ON A PERFORMER'S BODY

[75] Inventors: Hideo Suzuki; Shunichi Matsushima; Masahiko Obata; Masao Sakama, all of Hamamatsu, Japan

[73] Assignee: Yamaha Corporation, Hamamatsu, Japan

[21] Appl. No.: 281,553

[22] Filed: Dec. 8, 1988

[30] Foreign Application Priority Data

Dec. 24, 1987 [JP] Japan ..... 62-196200[U]
Feb. 10, 1988 [JP] Japan ..... 63-29113

[51] Int. Cl.[4] ..... G10H 1/18; G10H 1/32

[52] U.S. Cl. ..... 84/600; 128/782; 338/174

[58] Field of Search ..... 84/1.01, 1.19–1.27; 128/734, 741, 782, 420 A; 446/175, 297; 200/5 R, 5 A, 61.1, DIG. 2; 338/162, 174, 176

[56] References Cited

U.S. PATENT DOCUMENTS 3,704,339 11/1972 Niinomi ..... 84/1.24
3,705,948 12/1972 Tomisawa ..... 84/1.24
4,387,723 6/1983 Atlee et al. ..... 128/734
4,557,275 12/1985 Dempsey, Jr. ..... 128/782
4,580,569 4/1986 Petrofsky ..... 128/420 A
4,627,324 12/1986 Zwosta ..... 84/1.01
4,665,928 5/1987 Linial et al. ..... 128/782
4,667,685 5/1987 Fine ..... 128/782

FOREIGN PATENT DOCUMENTS 0264782 10/1987 European Pat. Off. .

*Primary Examiner*—Stanley J. Witkowski
*Attorney, Agent, or Firm*—Spensley, Horn, Jubas & Lubitz

[57] ABSTRACT

A musical tone control apparatus having first and second detectors mounted on a player's arm for detecting bending angles of the player's joints, and a musical tone control data generating circuit worn on the player's waist for generating musical tone control data based on output signals of the first and second detectors. The musical tone control data generating circuit is connected to the first detector via the second detector through a single common cable. Hence, the number of common cables can be reduced to a minimum, allowing free movement of the player. Further, the first detector having a potentiometer comprises first and second links rotatably connected at their ends so that the links rotate in a bending direction of the player's joint, a resistance element provided at the first link, and a sliding contact provided at the second link. The sliding contact, keeping contact with the resistance element, slides thereon with the rotation of the first or second link. The potentiometer produces a signal between the sliding contact and the terminal of the resistance element in response to a bending angle of the player's joint. Hence, the detector can be made thin, allowing free motion of the player's arm.

7 Claims, 6 Drawing Sheets

MUSICAL TONE CONTROL APPARATUS MOUNTED ON A PERFORMER'S BODY

BACKGROUND OF THE INVENTION

1. Field of the Invention

This invention relates to a musical tone control apparatus for controlling a musical tone in response to the movement at several portions of a player.

2. Prior Art

Conventionally, a musical tone is generated by playing a musical instrument such as a piano, a violin and the like or by use of vocal cords of a player: known musical instruments cannot convert a body action of player such as a rhythmic exercise into the corresponding musical tone.

Therefore, a musical tone control apparatus for converting the body action of player into a musical tone has been proposed (see European Patent Application Laid-Open No. 0264782 assigned to the same assignee as the present invention).

FIGS. 1 and 2 are figures showing the configuration of the musical tone control apparatus. This proposed musical tone control apparatus consists of a main body 1, a detector 2 for detecting motion of a player's right elbow, a detector 3 for detecting motion of a player's left elbow, and a detector 4 for detecting motion of a player's right hand. The main body 1 is worn round a player's waist by a belt 5 and the detectors 2, 3 and 4 are mounted on the player's right elbow, left elbow and right hand, respectively. The main body 1 comprises not only a musical tone control apparatus but also a musical tone signal generating circuit 26 controlled by the musical tone control apparatus, and a speaker 27.

Now, detailed description will be given about the conventional detectors 2, 3 and 4. First, as shown in FIG. 3, the detector 2 for player's right elbow consists of a supporter 7*a*, a potentiometer 8*a* attached to the supporter 7*a*, a lever 10*a* connected to a shaft 9*a* of the potentiometer 8*a*, and a cylinder 12*a* in which the tip of the lever 10*a* is inserted and whose end 14*a* is attached to the supporter 7*a*. When the right elbow is bent with the player's right arm movement, the cylinder 12*a* and the lever 10*a* revolve, causing the shaft 9*a* of the potentiometer 8*a* to rotate with a sliding element in the potentiometer 8*a*. The detector 3 is made similar to the detector 2; when the left elbow is moved, a cylinder 12*b* (FIG. 1) and a lever rotate a sliding element in a potentiometer 8*b*. Terminals of the potentiometers 8*a* and 8*b* in the detectors 2 and 3 are connected to the main body 1 through cables 15*a* and 15*b*.

The detector 4 includes a glove 16 made of an elastic material and a potentiometer 8*c*. The potentiometer 8*c* is attached to the wrist portion of the glove 16. As in the detector 2, a lever whose tip is inserted into a cylinder 12*c* is connected to a shaft of the potentiometer 8*c* and the cylinder 12*c* is attached to the glove 16. In addition, on the inside of four finger tips of the glove 16, strain transducers 17*a*–17*d* are fixed whose proper resistances vary in accordance with respective pressures exerted on corresponding finger tips. No pressure is exerted on the strain transducers 17*a*–17*d* when the fingers are stretched. On the other hand, when the fingers are bent, pressure proportional to bending angles of the finger tips are exerted on the strain transducers 17*a*–17*d*, resulting in a variation of their proper resistances. Terminals of the potentiometer 8*c* and strain transducers 17*a*–17*d* are connected to the main body 1 through a cable 15*c*.

In FIG. 2, 20 denotes a seven-channel analog multiplexer which can select one of the detection signals (voltage signals) applied from the potentiometers 8*a*–8*c* and the strain transducers 17*a*–17*d* based on the channel-selection signal CS applied to a selection terminal thereof. An A/D converter (analog-to-digital converter) 21 converts a detection signal from the analog multiplexer 20 into digital detection data of predetermined bits. A CPU (central processing unit) 22 controls the musical tone control apparatus using programs stored in a ROM (read only memory) 23. A RAM (random access memory) 24 is used as a work area. The CPU 22 supplies the sequentially varying channel-selection signal CS to the analog multiplexer 20 so that the outputs of the potentiometers 8*a*–8*c* and the pressure transducers 17*a*–17*d* are scanned at a high speed. In addition, the CPU 22 discriminates the bendng angles of the player's right and left elbows by use of four angle stages based on the detection data from the A/D converter 21. On the basis of the discrimination result, the CPU 22 generates key code data KC indicating one of the predetermined tone pitches in response to combination of the bending angles of the player's right and left elbows. Further, the CPU 22 discriminates the bending angle of the player's right wrist by use of three angle stages based on the detection data which are obtained by converting the signal from the potentiometer 8*c* with the A/D converter 21. On the basis of the discrimination result, the CPU 22 generates tone volume data VOL selectively designating one of the predetermined three tone volumes (i.e., big, middle and small tone volumes) in response to the bending angle of the player's right wrist. Moreover, the CPU 22 discriminates whether each of the four fingers (i.e., index finger, middle finger, ring finger and little finger) is bent or not. On the basis of the discrimination result the CPU 22 generates tone color data TD selectively designating one of the predetermined tone colors (such as a piano, an organ, a flute, a saxophone, a clarinet and the like) in response to the combination of bent fingers. The key code data KC, the tone volume data VOL, and the tone color data TD which are generated in CPU 22 (these data are generally called musical tone control data) are transferred to a musical tone signal generating circuit 26 through a bus line 25. The musical tone signal generating circuit 26 generates a musical tone signal having the tone pitch corresponding to the key code data KC, the tone volume corresponding to the tone volume data VOL, and the tone color corresponding to the tone color data TD. The musical tone signal outputted from the musical tone signal generating circuit 26 is supplied to a speaker 27 for producing a musical tone as well as to a transmitter circuit 28 for transmitting the musical tone signal by wireless.

According to the apparatus described above, the combination of the bending angles of the player's right and left elbows can change the tone pitch of the musical tone produced out of the speaker 27 in the main body 1. Further, the bending angle of the player's right wrist can change the musical tone volume at the three steps. Moreover, the combination of bent fingers among the player's four fingers can change the tone color of the musical tone. Thus movements of the player can control the musical tone.

In the above mentioned conventional musical tone control apparatus, however, the output of the detector 2 for the right elbow, the output of the detector 3 for the left elbow, and the output of the detector 4 for the right hand are respectively transferred to the main body 1 through separate cables 15*a*, 15*b* and 15*c*, resulting in that the cables, especially the cables 15*a* and 15*c* extending along the player's right arm to the main body 1 are apt to twist together when the player moves with the detectors 2–4 put on him. This hinders smooth movement of the player.

Further, when the detectors 2–4 are mounted on respective joints, they hinder the player's smooth motion by their rather bulky size, because these detectors 2–4 consist of the respective potentiometers 8*a*–8*c*, and the respective transmitting mechanisms (the levers and the cylinders 12*a*–12*c*) for transmitting movements of joints to the sliding elements in the potentiometers 8*a*–8*c*.

SUMMARY OF THE INVENTION

It is therefore an object of the invention to provide a musical tone control apparatus which can control the musical tone in response to the player's body actions without hindering smooth movement of the player.

According to one aspect of the present invention, there is provided a musical tone control apparatus comprising:

first detecting means for detecting movement of player's elbow and/or shoulder joint;

second detecting means for detecting movement of player's wrist and/or each finger joint;

musical tone control data generating means to be worn round the player's waist for generating musical tone control data based on output signals of the first and second detecting means; and transmitting means for transmitting the output signal of the first detecting means to the musical tone control data generating means by way of the second detecting means.

According to a more specific aspect of the invention, the first detecting means comprises:

fastening means to be worn on the player's joint;

first and second links removably mounted on the fastening means, the links being rotatably connected to each other at their ends so that the links rotate in a bending direction of the player's joint;

a resistance element provided at the connecting end of the first link; and a sliding contact provided at the connecting end of the second link, the sliding contact, keeping contact with the resistance element, sliding thereon with the rotation of the first or second link, whereby the first detecting means producing a signal between the sliding contact and the terminal of the resistance element in response to a bending angle of the player's joint.

DESCRIPTION OF THE PREFERRED EMBODIMENTS

The invention will now be described with reference to the accompanying drawings.

[A] FIRST EMBODIMENT

Figure 4:
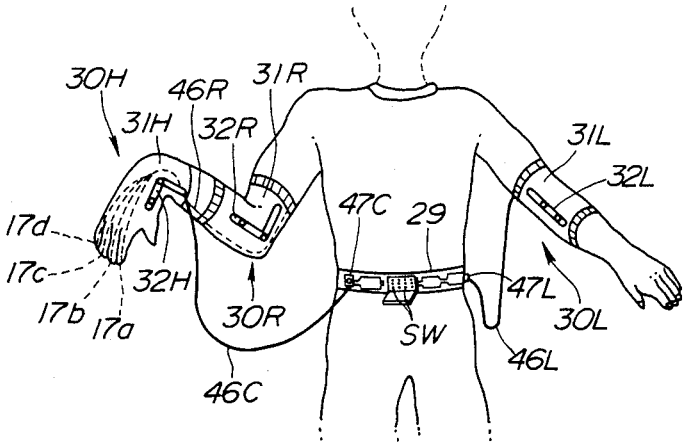
FIG. 4 is a front view showing the overall configuration of a musical tone control apparatus according to a first embodiment of the present invention.

In FIG. 4, a reference numeral 29 denotes a main body of a musical tone control apparatus worn round the player's wrist, 30R designates a detector mounted on the player's right elbow for detecting the bending angle of right elbow, 30L designates a detector mounted on the player's left elbow for detecting the bending angle of left elbow and 30H denotes a right hand detector mounted on the player's right hand for detecting the bending angle of wrist and a pressure exerted on each of four fingers of the player.

Figure 6:
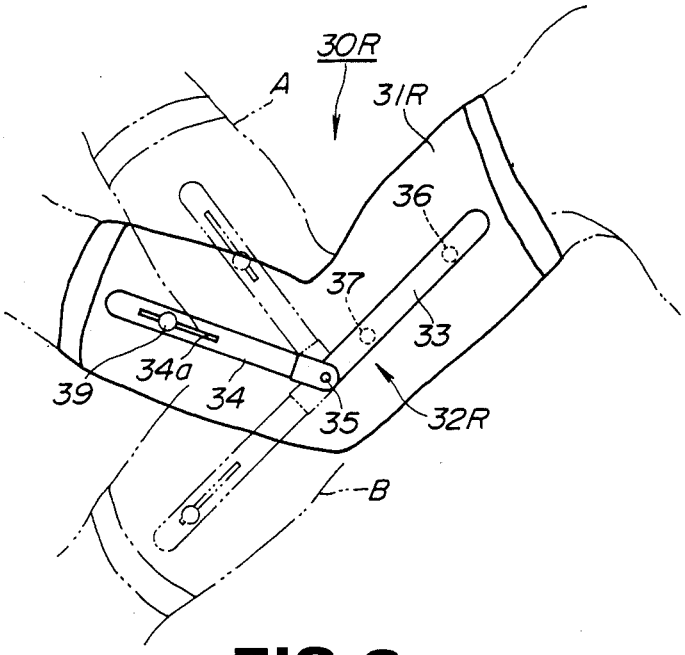
FIG. 6 is a front elevation showing the configuration of a detector 30R for player's right elbow according to the first embodiment.

The detector 30R for right elbow, as shown in FIG. 6, comprises a supporter 31R worn on the elbow joint portion of the player's right arm and an angular detector 32R. In FIG. 6, numerals 33, 34 denote first and second links, respectively, rotatably connected to each other at one end thereof by a pin 35. The links 33, 34 consist of elongated plastic plates or the like of about the same size. The first link 33 is removably mounted on the supporter 31R with hooks 36, 37. The second link 34 is provided with a lengthwise slot 34*a* to which a guide member 39 is slidably joined. The guide member 39 is removably attached to the supporter 31R with a hook (not shown).

Figure 7:
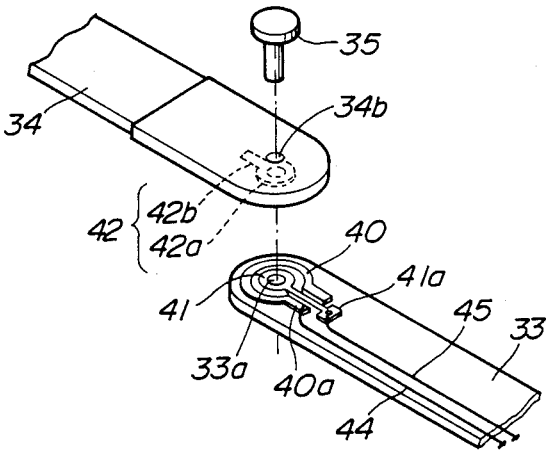
FIG. 7 is an exploded perspective view showing the main portion of the detector 30R according to the first embodiment.

At the facing ends of the links 33 and 34, as shown in FIG. 7, there are provided a resistance element 40, a fixed contact 41 and a sliding contact 42 functioning as a potentiometer. More specifically, the link 33 is provided with a hole 33*a* for inserting and fixing the pin 35; around the hole 33*a* there is provided the fixed contact 41, and the near-circle resistance element 40 is formed on a virtual circle whose center is the hole 33*a*. On the other hand, at the end of the link 34, there is provided a hole 34*b* into which the pin 35 is inserted loosely; around the hole 34*b*, there is provided the sliding contact 42 keeping contact with the resistance element 40 as well as with the fixed contact 41. The sliding contact 42 comprises a ring portion 42*a* which keeps contact with the fixed contact 41, and a projection 42*b* which slides on the resistance element 40 keeping contact therewith. While a lead wire 44 is connected to a terminal 40*a* at the end of the resistance element 40, a lead wire 45 is connected to a terminal 41*a* at the end of the fixed contact 41. The lead wires 44, 45 are led to the detector 30H through a cable 46R as shown in FIG. 4.

The detector 30R whose construction is described above is mounted on the player's right arm as shown in FIG. 6. When the player bends the right arm as shown by an alternate long and two short dashes line A in FIG. 6, or stretches it as shown by an alternate long and two short dashes line B, the link 34 revolves about the pin 35. Accompanying the revolution, the projection 42*b* of the sliding contact 42 slides on the resistance element 40. As a result, the resistance between the terminal 40*a* of the resistance element 40 and the terminal 41*a* of the fixed contact 41 varies in response to the displacement of the sliding contact 42, that is, the bending angle of the right arm. In this case, motion of the player's arm remains free because the guide member 39 slides along the slot 34*a* in response to the rotation of the link 34 with bending or stretching of the arm.

The detector 30L for the left elbow, as shown in FIG. 4, consists of a supporter 31L to be worn on the player's left elbow joint portion and an angular detector 32L removably mounted on the supporter 31L. In addition, the detector 30H for the right hand consists of a glove 31H and an angular detector 32H removably mounted on the glove 31H. The glove 31H is provided with strain transducers 17*a*–17*d* inside each of the four finger tips. Since the angular detectors 32L and 32H are similar to the above mentioned angular detector 32R, description thereof will be omitted here.

The signal outputted from the angular detector 32R of the detector 30R for the player's right elbow is first led to the detector 30H for the right hand through a cable 46R, and then conveyed to the main body 29 via the detector 30H. In other words, the signal outputted from the angular detector 32R is supplied to the main body 29 through a common cable 46C and connector 47C with signals produced by the angular detector 32H and the strain transducers 17*a*–17*d*. On the other hand, the detector 30L for the left elbow is connected to the main body 29 through a cable 46L and a connector 47L.

Figure 5:
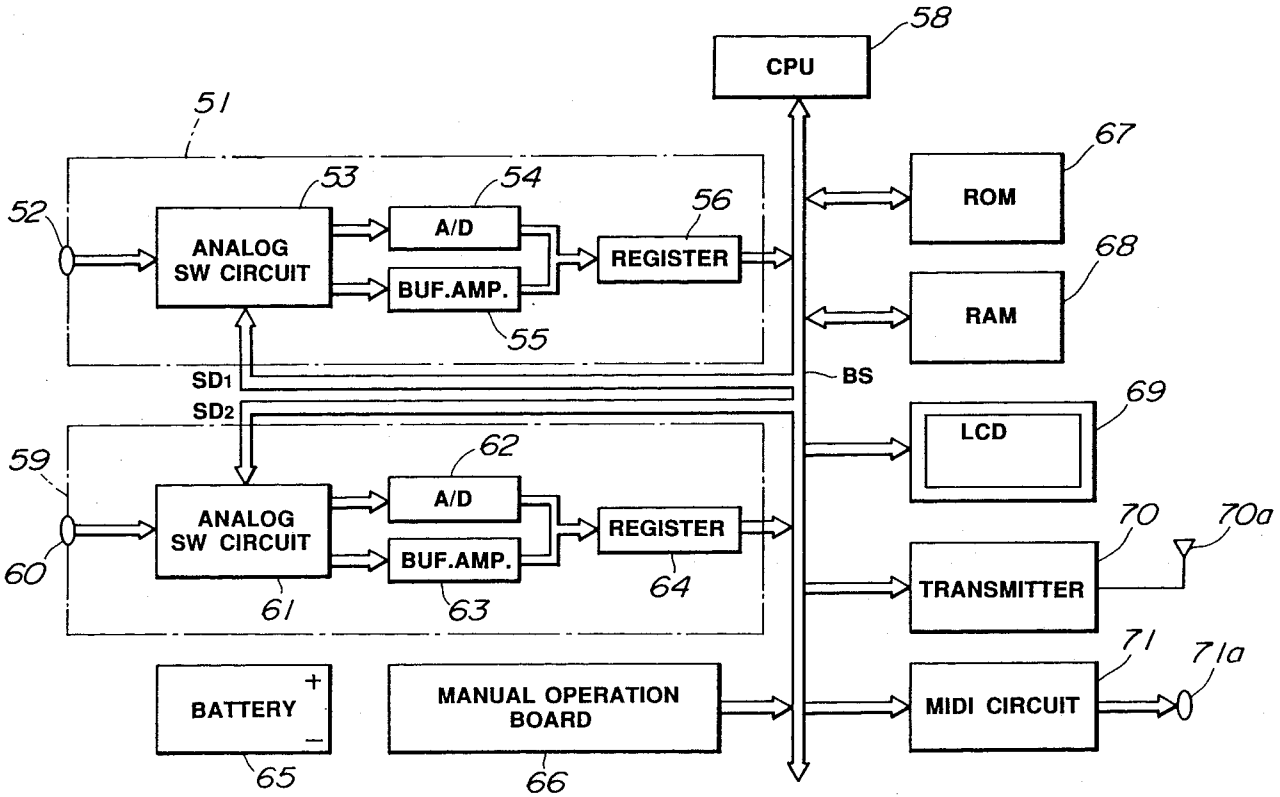
FIG. 5 is a block diagram showing the electric constitution of a main body 29 of the musical tone control apparatus according to the first embodiment.

The main body 29, as shown in FIG. 5, includes a receiver circuit 51 comprising a connector 52, an analog switch circuit 53, an A/D converter 54, a buffer amplifier 55, and a register 56. The connector 52, coupled with the connector 47C joined to the end of the common cable 46C extending from the detector 30H for the right hand, is connected to the input terminal of the analog switch circuit 53. Signals applied to the connector 52 may be digital or analog signals (though signals applied to the connector 52 are analog signals in the embodiment, the receiver circuit 51 is designed to deal with digital signals as well). Thus the analog switch circuit 53, having a plurality of analog switches, outputs signals supplied from the connector 52 either to the A/D converter 54 or to the buffer amplifier 55 based on a selection signal SD1 applied from a CPU 58. The A/D converter 54, converting the analog output signals of the analog switch circuit 53 to digital data, applies the data to the register 56. The buffer amplifier 55, amplifying the digital output signals of the analog switch circuit 53, outputs the signals to the register 56. The register 56, storing the data outputted from the A/D converter 54 or from the buffer amplifier 55, outputs the stored data to a bus line BS connected with the CPU 58.

A numeral 59 denotes the same receiver circuit as the receiver circuit 51 mentioned above. It consists of a connector 60, an analog switch circuit 61, an A/D converter 62, a buffer amplifier 63, and a register 64.

A battery 65 supplies a direct current to various parts of the apparatus. A manual operation board 66, as shown in FIGS. 4 and 8, consists of a plurality of push switches SW, SW, - - - , and an encoder for encoding the output of a depressed switch SW and applies the code to the bus line BS.

A ROM 67 stores programs used by the CPU 58 and a RAM 68 stored data. An LCD (liquid crystal display) 69 displays the states of the push switches SW, SW, - - - . A transmitter 70, modulating a carrier wave by such data as tone pitch data, tone color data, tone volume data, and key-on/off signal, radiates the modulated carrier from an antenna 70*a*. A MIDI (Musical Instrument Digital Interface) circuit 71, transforming such data as mentioned above into data of MIDI standard, supplies the data to an output terminal 71*a*.

Figure 8:
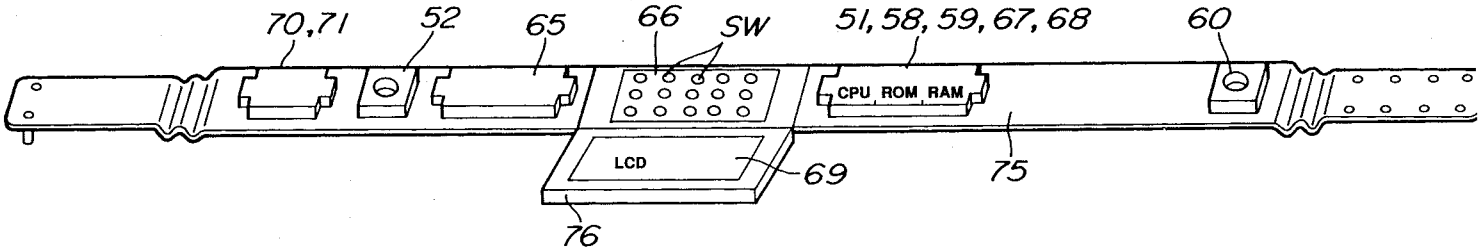
FIG. 8 is a perspective view showing the configuration of the musical tone control apparatus according to the first embodiment.

Electronic components constituting the main body 29 mentioned above are mounted on each holder arranged on a belt 75 shown in FIG. 8. Incidentally, the LCD 69 is mounted inside a lid 76 provided in the center of the belt 75 so that the player can easily watch the LCD by opening the lid 76 when necessary.

The operation of the musical tone control apparatus having the constitution mentioned above will be described. When playing, the player first wears the main body 29 round his waist, as shown in FIG. 4. Then, the detector 30R for the player's right elbow, the detector 30L for the left elbow, and the detector 30H for the right hand are fastened to the respective joints. Further, the connector 47*c* at the end of the common cable 46*c* extending from the detector 30H is coupled to the connector 52 of the main body 29, and the connector 47L at the end of the cable 46L extending from the detector 30L is connected to the connector 60 of the main body 29. Then, when a musical tone generating apparatus (not shown) is driven through wire, the output terminal 71*a* is connected with the musical tone generating apparatus by a connecting cable.

After these preparations, power sources in the musical tone generating apparatus and the main body 29 are turned on; the push switches of the manual operating board 66 are handed to select wire/wireless mode (the way for conveying data to the musical tone generating apparatus) and the kind of sensors attached to the player (although analog detectors are used in the present embodiment, digital detectors can also be used with the main body 29). Once the kind of sensors is selected, the CPU 58 detects it and outputs the selection data SD1 or SD2 depending on whether the kind of output signals of the sensors are analog or digital signals. As a result, the signal from the connector 52 is supplied to either the A/D converter 54 or to the buffer amplifier 55. The signal from the connector 60 is similarly treated. Then, the player depresses the push switch SW indicative of start, and starts the body action such as rhythmic exercise. Once the push switch SW is depressed to command the start, the signals applied to the connectors 52 and 60 are stored periodically in the registers 56 and 64 as detection data. The CPU 58 successively transfers the detection data stored in the registers 56 and 58 to the RAM 68, and produces the tone pitch data (key code), tone color data, tone volume data, and key-on/off data based on the transferred data just as in the conventional manner. The produced data are supplied to the MIDI circuit 71. The MIDI circuit 71 converts the data into the MIDI standard data and applies it to the output terminal 71*a*. The data from the output terminal 71*a* are supplied through the connecting cable to the musical tone generating apparatus wherein musical tone is generated based on these data.

On the other hand, when the wireless transmission is selected for conveying signals to the musical tone generating apparatus, data such as tone pitch data are applied to the transmitter 70. In addition, the states of manual operations of the push switches are displayed in the LCD 69.

Incidentally, in the above embodiment, the detector 30R is made to detect only the bending angle of the elbow joint. It may, however, be made to detect the bending angle of shoulder joint also by a detector similar to the angular detector 32R, the output signal of the detector being led to the main body 29 via the detector 30H for the right hand. Moreover, as an alternative to the angular detector 32R, an angular detector, employing a plurality of mercury switches each having a pair of electrodes sealed in a glass tube with mercury (whose details are shown in Japanese Patent Application No. 61-243348), can be used for detecting a right arm's swing angle. In other words, any detector may be used if it is satisfied that the output signals of the two detectors put on the same arm are transmitted to the main body 29 through a single common cable 46*c*.

According to the first embodiment, the output signal of the detector 30R (first detecting means for detecting movement of player's elbow and/or shoulder joint) is transmitted to the musical tone control data generating means via the detector 30H (second detecting means for detecting movement of player's wrist and/or each finger joint). Hence, the number of the transmitting means (cables) are reduced to the minimum so that the transmitting means do not hinder the player's motion.

Figure 1:
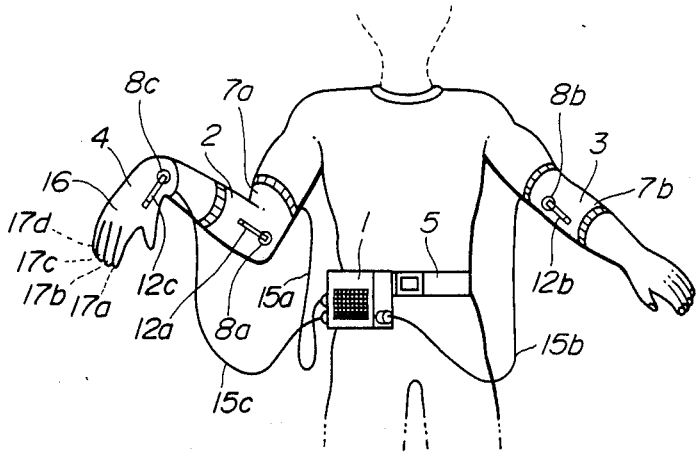
FIG. 1 (PRIOR ART)
FIG. 1 is a front view showing the overall configuration of a conventional musical tone control apparatus.
Figure 2:
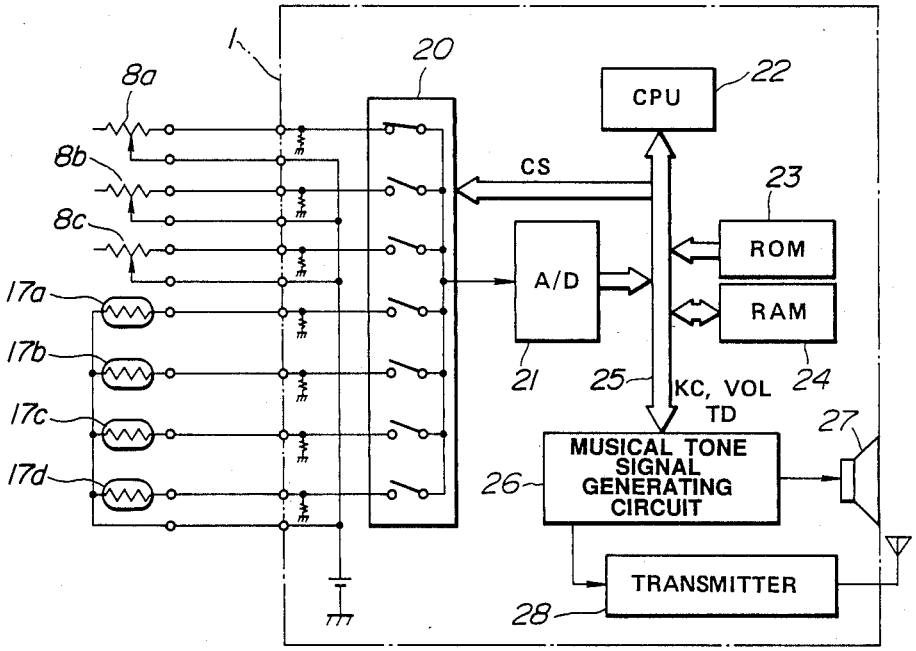
FIG. 2 (PRIOR ART)
FIG. 2 is a block diagram showing the electrical configuration of the conventional musical tone control apparatus shown in FIG. 1.
Figure 3:
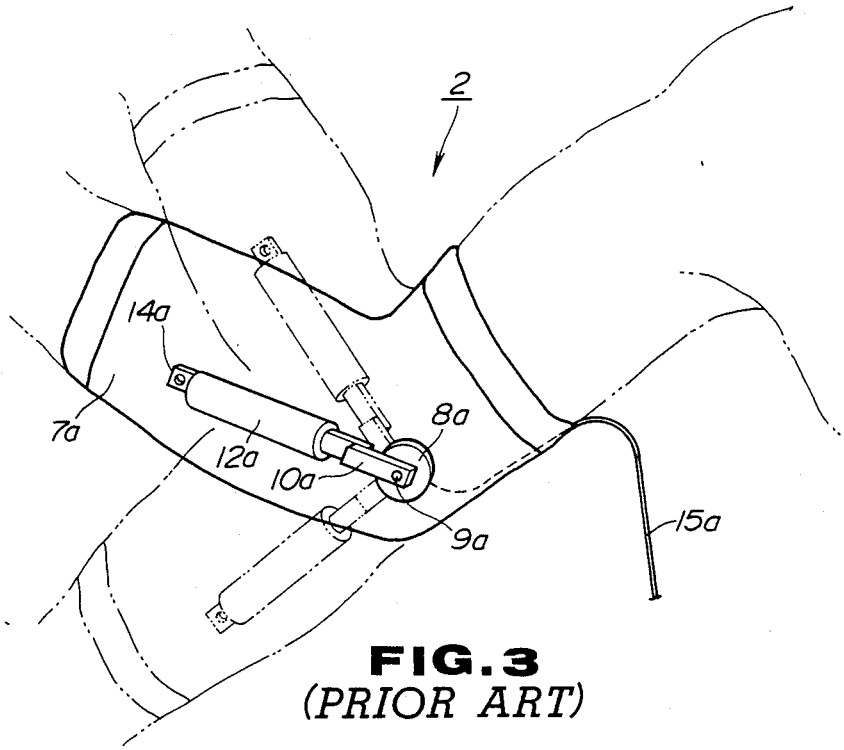
FIG. 3 (PRIOR ART)
FIG. 3 is a front elevation showing the detector of the conventional musical tone control apparatus shown in FIG. 1.

Further, since the potentiometer of the detector 30R consists of the resistance element 40, the fixed contact 41, and the sliding contact 41 formed at the ends of the links 33, 34, the detector 30R is made thinner than the conventional detector 2 shown in FIG. 3. Hence, it does not hinder the player's motion when it is worn on a player's joints. Moreover, precise detection of the bending angles is achieved without accurate positioning of the detector, because the links, whose connected portion is not fixed to the supporter, perform good rotation in response to bending of a player's joint.

[B] SECOND EMBODIMENT

The second embodiment of the present invention is the same as the first embodiment shown in FIG. 4 except for the detectors for a player's right and left elbows.

Figure 10A:
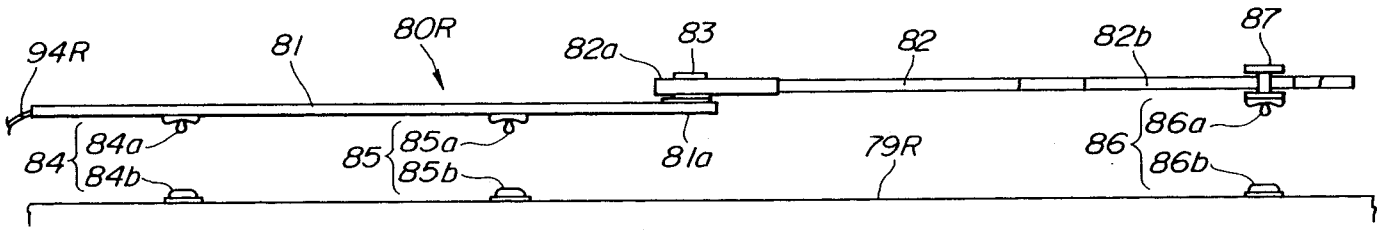
FIGS. 10A and 10B are, respectively, a partially broken side elevation and a front elevation showing an angular detector 80R according to the second embodiment.
Figure 10B:
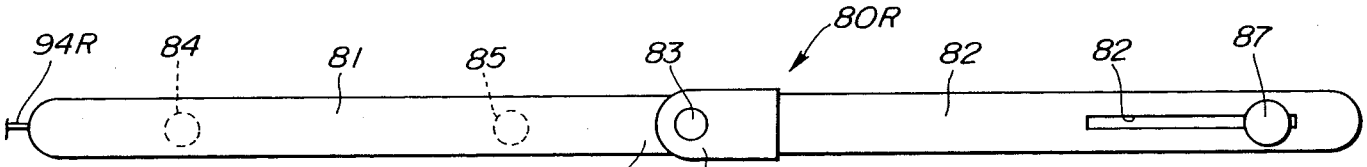
Figure 9:
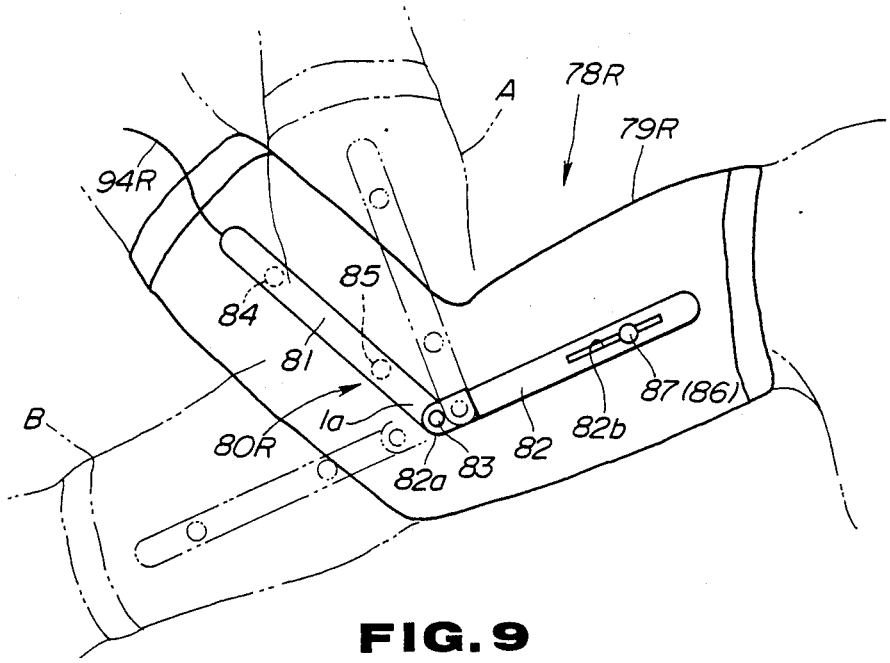
FIG. 9 is a front elevation showing the configuration of a detector 78R for player's right elbow according to a second embodiment of the present invention.

FIG. 9 is a front elevation showing the configuration of a detector 78R for player's right elbow according to the second embodiment of the invention. FIG. 10A and 10B are, respectively, partially broken side elevation and front elevation of an angular detector 80R.

The detector 78R for the right elbow consists of a supporter 79R and the angular detector 80R. The supporter 79R, to be worn on the elbow joint portion of the player's right arm, consists of an elastic material such s ENEL 8000 (trademark) composed of 84% of nylon and 16% of polyurethane.

The angular detector 80R has links 81, 82 rotatably connected to each other at each ends 81*a* and 82*a* by a pin 83. The links 81, 82 consist of elongated plastic plates or the like of about the same size and removably mounted on the supporter 79R with hooks 84, 85, 86.

The male hooks 84*a* and 85*a* of the hook 84 and 85 are attached to the back of the link 81, whereas the female hooks 84*b* and 85*b* to which the male hooks 84*a* and 85*a* are to be fixed are attached to the supporter 79R. On the other hand, the link 82 is provided with a lengthwise slot 82*b* into which a guide member 87 is slidably joined. The male hook 86*a* of the hook 86 is attached to the back of the guide member 87, and the female hook 86*b* to which the male hook 86*a* is to be fixed is attached to the supporter 79R.

At the facing ends 81*a* and 82*a* of the links 81 and 82, there is provided the same potentiometer as that shown in FIG. 7 (not shown in FIG. 9). In other words, the potentiometer consists of a resistance element and a fixed contact provided at the end 81*a*, and a sliding contact formed at the end 82*a*. The output of the potentiometer is transmitted to the detector 30H in FIG. 4 through a lead wire 94R.

The detector 78R whose construction is described above is mounted on the player's right arm as shown in FIG. 9. More specifically, on the portion of the upper arm covered by the supporter 79R, the link 82 is mounted by the guide member 87 attached to the supporter 79R by the hook 86 (by one point) so that the link 82 is able to slide longitudinally. On the other hand, on the portion of the forearm covered by the supporter 79R, the link 81 is attached by the hooks 84 and 85 (by two points). When the player bends the right arm as shown by an alternative long and two short dashes line A in FIG. 9, or stretches it as shown by an alternate long and two short dashes line B, the link 81 revolves about the pin 83. Accompanying the revolution, the resistance of the potentiometer varies in response to the position of the sliding contact, that is, the bending angle of the right arm. In this case, motion of the player's arm remains free because the guide member 87 slides along the slot 82*a* in response to the rotation of the links 81, 82 with the bending or stretching of the arm.

A detector for the left elbow (see FIG. 4) is the same as the detector 78R; a detector for the right hand is the same as the detector 30H in the first embodiment. Hence the description thereof will be omitted.

According to the second embodiment, the following advantages are obtained.

(1) Mounting the sliding link 82 on the covered portion of the upper arm by the supporter 79R allows smooth motion of the link 82 in response to the bending of the joint because the movement of the upper arm is more stable than that of the forearm, and this enables the link 82 to slide easily along the slot 82*b*.

(2) Attaching the link 81 to the forearm at the two points assures the fastening thereof even if a plump forearm of a player or some complex motion of a player's wrist such as twist may hinder the fastening of the link 81 to the forearm.

(3) The signal produced by the angular detector 80R is led first to the wrist and then to the main body 1 via a detector for the right hand. Hence, the detectors for the right arm are connected to the main body through a single common cable, avoiding twist of cables.

[C] THIRD EMBODIMENT

Figure 11:
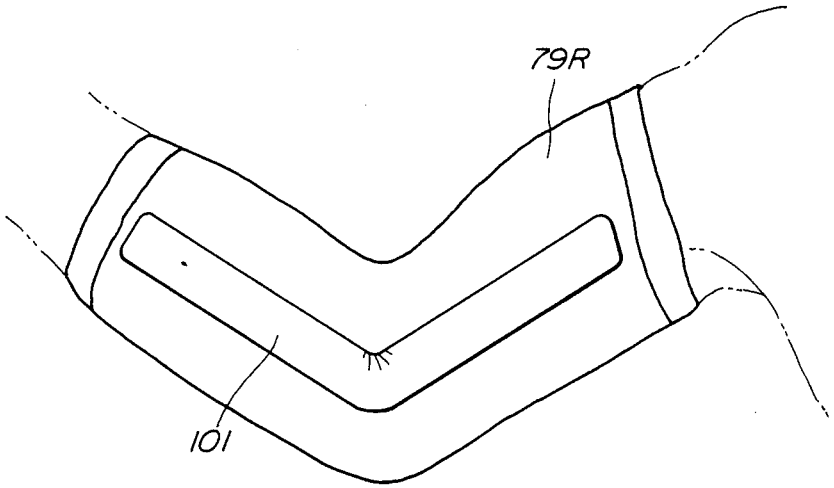
FIG. 11 is a front elevation showing the detector according to a third embodiment of the present invention.

FIG. 11 shows a detector for player's right elbow according to the third embodiment of the present invention.

In the third embodiment, the supporter 79R is made of film like polymeric rubber; a material like artificial skin, for example, such as BION.II (trademark) with high waterproof characteristic, high moisture permeability, and high elasticity. This improves the movement of the links 81 and 82 constituting the angular detector 80R. In addition, a cover 101, covering the angular detector 80R, is sewed to the supporter 79R; the double layer structure thus formed improves resistance to sweat and prevents player's sweat from sticking to metal parts such as the resistance element, fixed contact, or the sliding contact.

Although specific embodiments of a musical tone control apparatus constructed in accordance with the present invention has been disclosed, it is not intended that the invention be restricted to either the specific configurations or the uses disclosed herein. Modifications may be made in a manner obvious to those skilled in the art. Accordingly, it is intended that the invention be limited only by the scope of the appended claims.

What is claimed is:

1. A musical tone control apparatus comprising:

first detecting means for detecting movement of a player's elbow and/or shoulder joint;

second detecting means for detecting movement of the player's wrist and/or each finger joint;

musical tone control data generating means to be worn round the player's waist for generating musical tone control data based on output signals of said first and second detecting means; and transmitting means for transmitting the output signal of the first detecting means to the musical tone control data generating means by way of the second detecting means.

2. A musical tone control apparatus according to claim 1 further comprising covering means for covering the first detecting means.

3. A musical tone control apparatus comprising;

fastening means to be worn on the player's joint;

first and second links removably mounted on the fastening means, said links being rotatably connected to each other at their ends so that said links rotate in a bending direction of the player's joint;

a resistance element provided on said first link;

a sliding contact provided on said second link, said sliding contact keeping contact with said resistance element and sliding thereon in accordance with the rotation of said first or second link; and control data generating means for generating control data controlling a musical tone signal to be produced based on a signal produced between said sliding contact and a terminal of said resistance element in response to a bending angle of the player's joint.

4. A musical tone control apparatus according to claim 3, wherein said first and second links are removably mounted on said fastening means at two points of said first link excluding the connecting point and at one point of said second link excluding said connecting point so that the connecting part of said first and second links is to be positioned at the player's joint.

5. A musical tone control apparatus according to claim 3, wherein said first link is placed on the player's forearm and said second link is placed on the player's upper arm.

6. A musical tone control apparatus according to claim 3 further comprising guiding means removably attached to said fastening means, said second link being provided with a lengthwise slot in which said guiding means is slidably inserted.

7. A musical tone control apparatus according to claim 3, wherein said fastening means is a supporter made of film like rubber.

* * * * *